US009098032B2

(12) United States Patent
Monde et al.

(10) Patent No.: US 9,098,032 B2
(45) Date of Patent: Aug. 4, 2015

(54) IMAGE HEAD APPARATUS INCLUDING OVERHEATING PREVENTING ELEMENT CONFIGURED TO INTERRUPT ELECTRICAL POWER SUPPLY TO HEATER

(71) Applicant: CANON KABUSHIKI KAISHA, Tokyo (JP)

(72) Inventors: Masafumi Monde, Yokohama (JP); Masaru Tanaka, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 187 days.

(21) Appl. No.: 13/870,412

(22) Filed: Apr. 25, 2013

(65) Prior Publication Data

US 2013/0302046 A1 Nov. 14, 2013

(30) Foreign Application Priority Data

May 10, 2012 (JP) ..... 2012-108474

(51) Int. Cl.
*G03G 15/20* (2006.01)

(52) U.S. Cl.
CPC ..... *G03G 15/205* (2013.01); *G03G 15/2053* (2013.01); *G03G 15/2039* (2013.01); *G03G 2215/2035* (2013.01)

(58) Field of Classification Search
CPC ..... G03G 15/205; G03G 15/2039; G03G 15/2053; G03G 2215/2035
USPC ..... 399/33, 329; 219/216
See application file for complete search history.

(56) References Cited

U.S. PATENT DOCUMENTS

| | | | | |
|---|---|---|---|---|
| 6,075,228 | A * | 6/2000 | Goto et al. | 219/216 |
| 7,009,153 | B2 | 3/2006 | Tomatsu | |
| 7,650,105 | B2 | 1/2010 | Ogawa et al. | |
| 7,881,650 | B2 | 2/2011 | Shin et al. | |
| 8,032,069 | B2 | 10/2011 | Shin et al. | |
| 8,364,067 | B2 | 1/2013 | Miki et al. | |
| 8,412,084 | B2 * | 4/2013 | Ishida et al. | 399/329 |
| 2004/0222214 | A1 | 11/2004 | Tomatsu | |
| 2007/0077077 | A1 | 4/2007 | Jeong et al. | |
| 2009/0092423 | A1 | 4/2009 | Shin et al. | |
| 2011/0091254 | A1 | 4/2011 | Shin et al. | |
| 2011/0150544 | A1 | 6/2011 | Ishida et al. | |
| 2011/0236084 | A1 | 9/2011 | Nishida et al. | |

(Continued)

FOREIGN PATENT DOCUMENTS

| | | |
|---|---|---|
| CN | 1160876 A | 10/1997 |
| CN | 1521578 A | 8/2004 |

(Continued)

OTHER PUBLICATIONS

Chinese Office Action issued in counterpart Chinese Patent Application No. 201310170636.6, dated Mar. 27, 2015 and English translation thereof.

*Primary Examiner* — William J Royer
(74) *Attorney, Agent, or Firm* — Fitzpatrick, Cella, Harper & Scinto

(57) ABSTRACT

An image heating apparatus includes: a rotatable cylindrical belt; a heater, provided inside the belt, for heating the belt; and an overheating preventing element, including a circuit which is opened when abnormal temperature rise occurs, for interrupting electric power supply to the heater. The overheating preventing element is provided at a position, inside the belt, where the overheating preventing element is free from direct heat radiation emitted from said heater.

13 Claims, 6 Drawing Sheets

(56) References Cited

U.S. PATENT DOCUMENTS

| | | | | |
|---|---|---|---|---|
| 2011/0305474 | A1 | 12/2011 | Tanaka et al. | |
| 2012/0099882 | A1 | 4/2012 | Tanaka | |
| 2012/0155938 | A1 | 6/2012 | Tanaka et al. | |
| 2012/0308279 | A1 | 12/2012 | Tanaka et al. | |
| 2013/0129364 | A1 | 5/2013 | Kitagawa et al. | |
| 2013/0206745 | A1* | 8/2013 | Tanaka et al. | 219/469 |
| 2013/0272762 | A1* | 10/2013 | Uekawa et al. | 399/329 |

FOREIGN PATENT DOCUMENTS

| | | | |
|---|---|---|---|
| CN | 1940771 | A | 4/2007 |
| CN | 101403884 | A | 4/2009 |
| JP | 2009-93141 | A | 4/2009 |

* cited by examiner (a)

(b)

IMAGE HEAD APPARATUS INCLUDING OVERHEATING PREVENTING ELEMENT CONFIGURED TO INTERRUPT ELECTRICAL POWER SUPPLY TO HEATER

FIELD OF THE INVENTION AND RELATED ART

The present invention relates to an image heating apparatus suitable when it is used as a fixing apparatus (fixing device) to be mounted in an image forming apparatus such as an electrophotographic copying machine or an electrophotographic printer.

As the fixing apparatus to be mounted in the image forming apparatus, a fixing apparatus of a belt type in which a cylindrical film which has high energy efficiency to quickly raise a surface temperature and which has a very small thermal capacity (hereinafter referred to as a belt member) is radiation-heated from its inside by a heat source such as a halogen heater has been proposed (Japanese Laid-Open Patent Application (JP-A) 2009-93141).

Such a fixing apparatus of the belt type has the small thermal capacity and a high temperature rise speed, and therefore may only be required to be heated only during printing. Accordingly, the fixing apparatus has advantages such that a time from turning-on of a main switch until the image forming apparatus is in a printable state is short and that also electric power consumption during stand-by for printing is considerably small.

The present invention relates to an image heating apparatus suitable for use as a fixing apparatus (fixing device) to be mounted in an image forming apparatus, such as an electrophotographic copying machine or an electrophotographic printer.

As the fixing apparatus to be mounted in the image forming apparatus, a fixing apparatus of a belt type has been proposed in which a cylindrical film which has high energy efficiency to quickly raise a surface temperature and which has a very small thermal capacity (hereinafter referred to as a belt member) is radiation heated from its inside by a heat source such as a halogen heater (Japanese Laid Open Patent Application (JP A) 2009 93141).

Such a fixing apparatus of the belt type has the small thermal capacity and a high temperature rise speed, and therefore may only be required to be heated only during printing. Accordingly, the fixing apparatus has advantages such that the time from turning on of a main switch until the image forming apparatus is in a printable state is short and that electrical power consumption during a printing stand-by state is considerably small.

Incidentally, the fixing apparatus includes an overheating preventing element, such as a thermo switch or a thermal fuse, for interrupting electrical power supply to the heat source, which is ready for the case where the heat source is abnormally heated due to breakdown (failure) of a controller or the like, and therefore also the fixing apparatus of the belt type requires the overheating preventing element. As an example of a position where the overheating preventing element is provided, it would be considered that the overheating preventing element is disposed in non-contact with the belt member so that a surface of the belt member is not damaged. Further, the overheating preventing element is needed to be disposed, for ensuring its operation reliability, at a position where the overheating preventing element is prevented from being directly subjected to radiation of heat radiation by the halogen heater. Therefore, in order to prevent the damage on the belt member and to ensure the operation reliability of the overheating preventing element, the type in which the overheating preventing element is disposed in non-contact with the belt member in the neighborhood of an outside of the cylinder of the belt member has been used in general.

However, the fixing apparatus of the belt type involves the following problem. When the overheating preventing element is disposed in non-contact with the belt member in the neighborhood of the outside of the cylinder of the belt member, the operation time of the overheating preventing element becomes slow compared with the case where the overheating preventing element is disposed in contact with the belt member. Further, when the cases where the belt member is rotated and is not rotated are compared, a spatial distance is changed and also the operation time of the overheating preventing element varies. Further, during rotation of the belt member, the shape and attitude of the belt member fluctuate (i.e., a rotation locus is fluctuated), but even when this fluctuation is caused, the surface damage of the belt member must be prevented.

Therefore, when the spatial distance between the overheating preventing element and the belt member is made sufficiently large in order to prevent the contact between the overheating preventing element and the belt member, the time until the overheating preventing element is actuated becomes long.

Further, with an increase in electrical power of the fixing apparatus due to speeding up of the fixing apparatus, further reduction in the operation time of the overheating preventing element is required. For that reason, when the overheating preventing element is disposed in non-contact with the belt member in the neighborhood of the outside of the cylinder of the belt member, there arises the case where the demands for reduction and stabilization in the operation time of such an overheating preventing element cannot be met.

Therefore, when the overheating preventing element is disposed inside the cylinder of the belt member so that the operation time of the overheating preventing element is not adversely affected even when the belt shape fluctuates, there is a problem of ensuring of the operation reliability of the overheating preventing element. When the overheating preventing element is disposed inside the cylinder of the belt member, the overheating preventing element is directly subjected to the radiation of the heat rays from the halogen heater so that the ambient temperature exceeds the operation environment temperature range of the overheating preventing element. Further, not only a heat sensitive surface of the overheating preventing element but also the overheating preventing element as a whole are increased in temperature, so that there is a possibility that a malfunction and breaking of the overheating preventing element are caused to occur.

SUMMARY OF THE INVENTION

A principal object of the present invention, there is provided an image heating apparatus capable of realizing stabilization of an operation time of an overheating preventing element and capable of ensuring operation reliability.

According to an aspect of the present invention, there is provided an image heating apparatus comprising: a rotatable cylindrical belt; a heater, provided inside the belt, for heating the belt; and an overheating preventing element, including a circuit which is opened when an abnormal temperature rise occurs, for interrupting electrical power supply to the heater, wherein the overheating preventing element is provided at a position, inside the belt, where the overheating preventing element is free from direct heat radiation emitted from said heater.

According to another aspect of the present invention, there is provided an image heating apparatus comprising: a rotatable cylindrical belt; a heater, provided inside the belt, for heating the belt; an overheating preventing element, including a circuit which is opened when an abnormal temperature rise occurs, for interrupting electrical power supply to the heater; and a metal member provided at a position, inside the belt, where the metal member is subjected to direct heat radiation emitted from the heater, wherein the metal member includes a protruded portion protruded from an end of the belt with respect to a direction of generatrix of the belt, wherein the overheating preventing element detects a temperature of the metal member at the protruded portion of the metal member.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 2(*b*) is a perspective view of an outer appearance of a flange member, a heater fixing member, a sealing portion and an element fixing member which are provided at a longitudinal end portion of a heating unit. FIG. 2(*c*) is an illustration showing radiation of heat rays from a halogen heater with respect to a longitudinal direction of a heating belt and showing a position of an overheating preventing element.

FIG. 3(*b*) is an illustration showing radiation of heat rays from a halogen heater with respect to a radial direction of a heating belt and showing a position of an overheating preventing element.

DESCRIPTION OF THE PREFERRED EMBODIMENTS

In the following, embodiments of the present invention will be described in detail with reference to the drawings. The following embodiments do not limit the present inventions according to claims, and all of combinations of features described in the embodiments are not necessarily essential to solution means of the present invention.

First Embodiment

(1) Image Forming Apparatus

Figure 5:
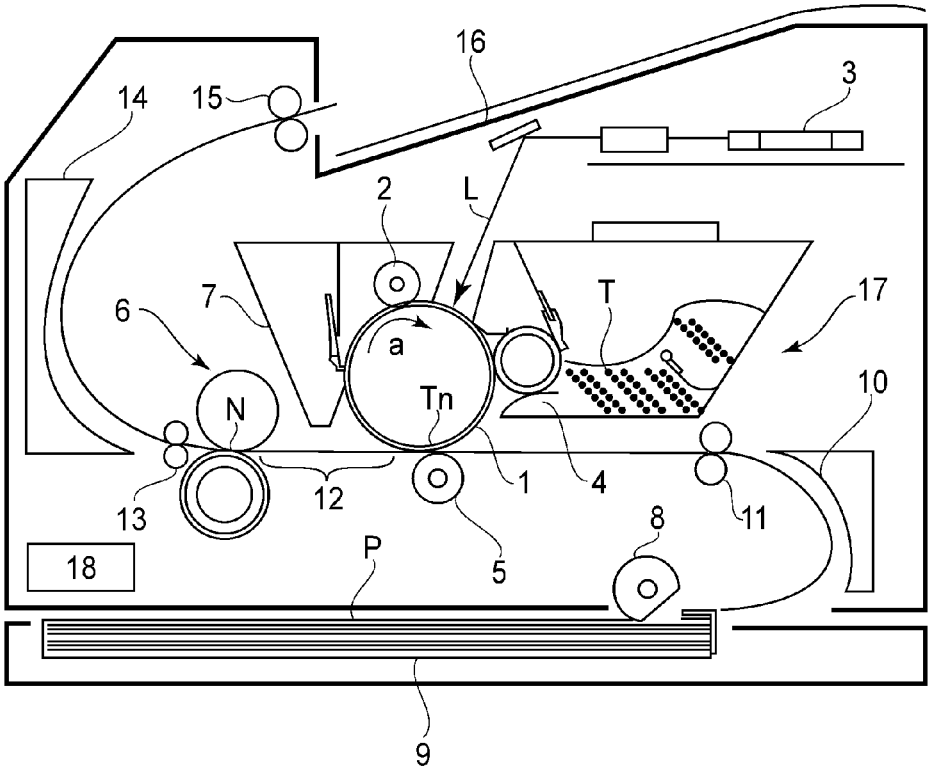
FIG. 5 is a schematic illustration of an example of an image forming apparatus.

FIG. 5 is a schematic illustration of an example of an image forming apparatus in which an image heating apparatus according to the present invention is mounted as a fixing apparatus. The image forming apparatus in this embodiment is a laser beam printer using an electrophotographic process of a transfer type.

The image forming apparatus in this embodiment includes an image forming portion 17, a fixing portion (fixing apparatus) 6, a controller 18 for controlling the image forming portion 17 and the fixing portion 6, and the like. The controller 18 comprises a CPU and a memory such as RAM or ROM, and in the memory, an image forming sequence, various programs necessary for image formation, and the like are stored.

At the image forming portion 17, as an image bearing member, a rotation-drum-type electrophotographic photosensitive member (hereinafter referred to as a photosensitive drum) 1 is provided. This photosensitive drum 1 is constituted by forming a photosensitive material layer of OPC, amorphous Se, amorphous Si, or the like on an outer peripheral surface of a cylinder (drum) like electroconductive substrate of nickel or aluminum. The controller 18 rotationally drives a motor (not shown) depending on a print command (instruction) outputted from an external device (not shown) such as a host computer, so that the photosensitive drum 1 is rotated in a direction indicated by an arrow a at a predetermined peripheral speed (process speed).

This photosensitive drum 1 is, in a rotation process thereof, electrically charged uniformly to a predetermined polarity and a predetermined potential by a charging roller 2 as a charging means.

Then, the charged surface of the photosensitive drum 1 is subjected to scanning exposure to a laser beam L which is outputted from a laser beam scanner 3 and which is modulation-controlled (ON/OFF-controlled) depending on image information from the external device. As a result, an electrostatic latent image of intended image information is formed on the surface of the photosensitive drum 1.

Then, the electrostatic latent image formed on the surface of the photosensitive drum 1 is developed with a toner T by a developing device 4 as a developing means, thus being visualized as a toner image. As a developing method, a jumping developing method, a two-component developer type developing method and the like are used and are, in many cases, used in combination with image exposure and a reverse developing method.

On the other hand, sheets of a recording material P accommodated in a (sheet) feeding cassette 9 are fed one by one by rotation of a (sheet) feeding roller 8 at predetermined feeding timing. This recording material P passes through a sheet path including a guide 10, a registration roller 11, and the like, and is fed to a transfer nip Tn formed between the surface of the photosensitive drum 1 and an outer peripheral surface of a transfer roller 5 as a transfer means, and then is nipped and conveyed between the surface of the photosensitive drum 1 and the surface of the transfer roller 5. In this conveying process, by applying a predetermined transfer bias to the transfer roller 5, the toner image on the surface of the photosensitive drum 1 is transferred and carried on the recording material P.

The recording material P which is separated from the surface of the photosensitive drum 1 and then comes out of the transfer nip Tn is guided into the fixing apparatus (fixing device) 6 by a conveying guide 12, and then an unfixed toner image on the recording material P is heat-fixed on the recording material P by heat and pressure applied from the fixing apparatus 6. A constitution of the fixing apparatus 6 will be specifically described in (2) below.

The recording material P coming out of the fixing apparatus 6 passes through a sheet path including a conveying roller 13, a guide 14, a discharging roller 15, and the like, thus being printed out on a discharge tray 16.

The surface of the photosensitive drum 1 after the separation of the recording material P is subjected to removal (process) of a deposited contaminant such as a transfer residual toner by a cleaning device 7, thereby to be cleaned, and then is repetitively subjected to the image formation.

(2) Fixing Apparatus (Image Heating Apparatus) 6

In the following description, with respect to the fixing apparatus 6 and members constituting the fixing apparatus 6, a longitudinal direction refers to a direction perpendicular to a recording material conveyance direction C (FIG. 1A) in a plane of the recording material P. A widthwise direction refers to a direction parallel to the recording material conveyance direction C in the plane of the recording material P. A width refers to a dimension with respect to the widthwise direction.

Figure 1A:
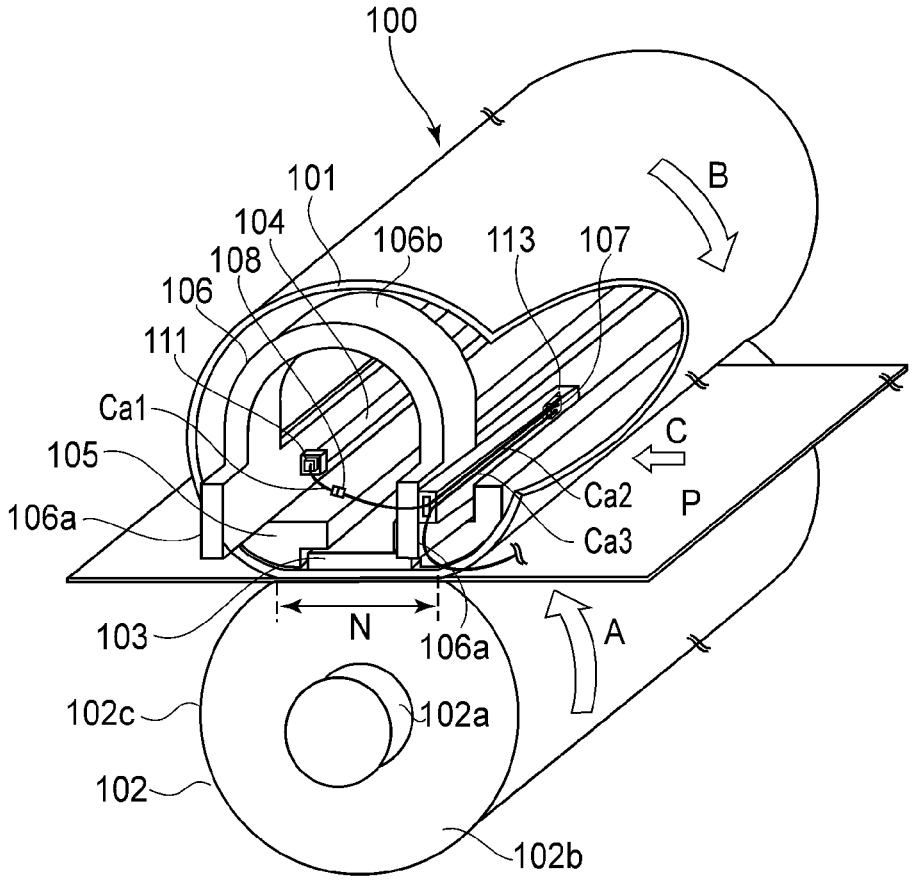
FIG. 1A is a perspective view of an outer appearance showing a schematic structure of a whole fixing apparatus according to a First Embodiment.
Figure 1B:
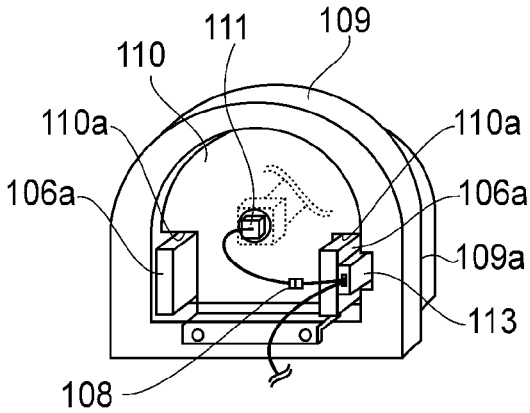
FIG. 1B is a perspective view of an outer appearance showing a halogen heater supporting structure at a longitudinal end portion of a heating unit.
Figure 1C:
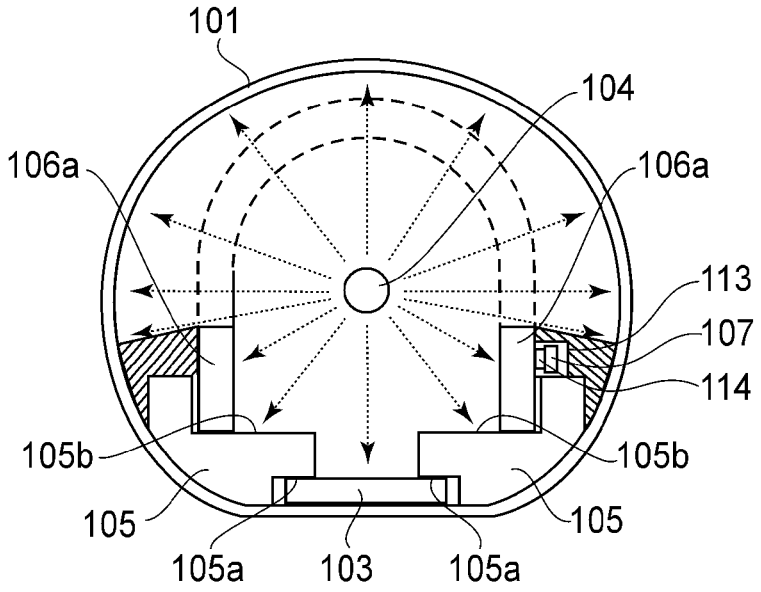
FIG. 1C is an illustration showing radiation of heat rays from a halogen heater with respect to a radial direction of a heating belt and showing a position of an overheating preventing element.
Figure 1D:
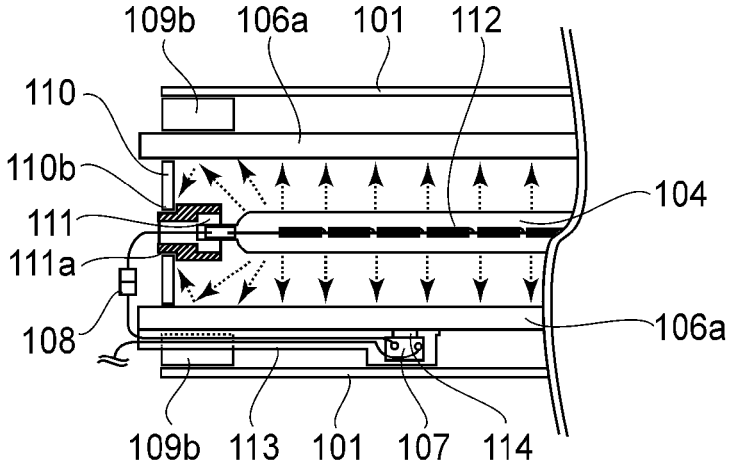
FIG. 1D is an illustration showing the radiation of the heat rays from the halogen heater with respect to a longitudinal direction of the heating belt and showing the position of the overheating preventing element.

FIGS. 1A to 1D are schematic views showing a constitution of the fixing apparatus 6 of the belt type according to this embodiment and an arrangement of an overheating preventing element 107. FIG. 1A is a perspective view of an outer appearance showing a schematic structure of a whole fixing apparatus 6. FIG. 1B is a perspective view of an outer appearance of a flange member 109, a heater fixing member 110, a sealing portion 111 and an element fixing member 113 which are provided at a longitudinal end portion of a heating unit 100 (FIG. 1A). FIG. 1C is an illustration showing radiation of heat rays from a halogen heater 104 with respect to a radial direction of a heating belt 101 and showing a position of an overheating preventing element 107. FIG. 1D is an illustration showing the radiation of the heat rays from the halogen heater 104 with respect to a longitudinal direction of the heating belt 101 and showing the position of the overheating preventing element 107.

In FIG. 1A, in order to illustrate a structure of an inside of the heating belt 101, a part of the heating belt 101 at a longitudinal end portion is cut away. Although not illustrated, the flange member 109, the heater fixing member 110 and the sealing portion 111 are provided also at another longitudinal end portion of the heating unit 100.

The fixing apparatus 6 in this embodiment is roughly divided into the heating unit 100 for heating the unfixed toner image (not shown) formed on the recording material P and a pressing roller (pressing member) 102 for forming a fixing nip N in contact with the heating belt 101 of the heating unit 100. The heating unit 100 is prepared by integrally assembling members such as the rotatable cylindrical heating belt (belt member) 101, a slidable member 103 contacted to an inner surface of the heating belt 101 at a position where it opposes the pressing roller 102, a halogen heater 104, a holding member 105 for holding the slidable member 103, a stay (metal member) 106 for imparting rigidity (stiffness) to the fixing apparatus 6 (particularly to the heating unit 100), and the heater fixing member 110.

Each of the heating belt 101, the pressing roller 102, the halogen heater 104, the slidable member 103, the holding member 105 and the stay 106 is an elongated member extending in the longitudinal direction.

The holding member 105 holds the slidable member 103 at a recessed portion 105*a* (FIG. 1C) provided in a fixing nip N side thereof. Further, the holding member 105 has a stepped portion 105*b* on a side opposite from the fixing nip N side thereof, and holds the stay 106 at the stepped portion 105*b*.

The stay 106 has a leg portion 106*a* (FIG. 1A), and the leg portion 106*a* is mounted on the stepped portion 105*b*. The leg portion 106*a* is connected at each of longitudinal end portions of the stay 106 by an arch like connecting portion 106*b* (FIG. 1A). The connecting portion 106*b* is provided at a position where it can guide rotation of the heating belt 101 at the longitudinal end portion and where heat rays radiating from the halogen heater 104 toward the heating belt 101 are not shielded. The stay 106 is made of metal and has rigidity capable of withstanding pressure by a pressing mechanism described later.

An outer peripheral portion of an assembly of the holding member 105, the slidable member 103, and the stay 106 are externally engaged loosely with the heating belt 101 formed with a cylindrical heat resistant film. In order to limit lateral movement of the heating belt 101 in the longitudinal direction in a rotation state and in order to fix the stay 106 on an apparatus frame (not shown) of the fixing apparatus 6, the flange member 109 is engaged at each of the longitudinal end portions of the stay 106.

The flange member 109, which is disposed at the longitudinal end portion of the stay 106 and which has a substantially D character shape at its side surface, is engaged with the leg portion 106*a* and connecting portion 106*b* of the stay 106 (FIG. 1B). Further, the flange member 109 is supported by the apparatus frame (not shown) of the fixing apparatus 6 at its outer peripheral surface. An inner surface 109*a* of the flange member 109 at the heating belt 101 side contacts a longitudinal end surface of the heating belt 101 to constitute a limiting surface for limiting the lateral movement of the heating belt 101. The flange member 109 also has an opposing surface 109*b* (FIG. 1D) where it opposes an inner surface of the heating belt 101 at the end portion of the heating belt 101. Incidentally, in FIG. 1B, a belt limiting portion of the flange member 109 is omitted from illustration.

As shown in FIG. 1B, inside the flange member 109, the heater fixing member 110 is engaged and fixed, so that the longitudinal end portion of the halogen heater 104 is fixed and supported by the sealing portion 111 engaged and fixed to a central portion of the heater fixing member 110. In each of widthwise sides of the heater fixing member 110, a through hole 110*a* is provided, and the leg portion 106*a* of the stay 106 is passed through the through hole 110*a* to be exposed to the outside of the heater fixing member 110.

The sealing portion 111 is constituted so that it has an electrical electric energy supplying structure supplying electrical energy to a filament 112 (FIG. 1D) of the halogen heater 104 and so that it renders airtight the inside of a glass tube of the halogen heater 104. As shown in FIG. 1D, the heater fixing member 110, engaged and fixed with the flange member 109, has a circular hole 110*b* at its central portion, and in the circular hole 110*b*, an outer peripheral portion, having a small diameter, of a stepped portion 111*a* provided at the sealing portion 111 is engaged. As a result, the halogen heater 104 is fixed so as not to be moved in the longitudinal direction and a radial direction.

In the heating unit 100, the stay 106 is disposed inside the heating belt 101, and inside the stay 106, the halogen heater 104 is provided. Further, radiant light emitted from the halogen heater 104 passes through a cut away portion provided between a pair of the connecting portions 106*b* of the stay 106, so that the inner peripheral surface of the heating belt 101 is irradiated with the radiant light (FIG. 1C). On the other hand, the leg portion 106*a* shields a part of the belt inner surface from the radiant light.

The pressing roller 102 is a member including a metal core 102*a*, an elastic layer 102*b* which is provided on the outer peripheral surface of the metal core 102*a* and which is formed of a silicone rubber or the like, and a parting layer 102*c* which is provided on the outer peripheral surface of the elastic layer 102*b* and which is formed of a fluorine containing resin. The pressing roller 102 is disposed opposed to the slidable member 103 of the heating unit 100 via the heating belt 101, and at its position, the metal core 102*a* is rotatably supported at its longitudinal end portions by the apparatus frame via bearings (not shown).

At each of the longitudinal end portions of the stay 106 of the heating unit 100, the pressing mechanism (not shown) including a pressing spring or the like is provided and presses the stay 106 at the longitudinal end portion of the stay 106 in a direction perpendicular to a direction of generatrix of the heating belt 101. By the pressing of the pressing mechanism, the stay 106 presses the slidable member 103 in the same direction via the holding member 105, so that the slidable member 103 presses the outer peripheral surface of the heating belt 101 to the outer peripheral surface of the pressing roller 102, so that the heating belt 101 is contacted (circumscribed) to the pressing roller 102. As a result, the elastic layer 102*b* of the pressing roller 102 is deformed, so that the fixing nip N having a predetermined width is formed by the surface of the pressing roller 102 and the surface of the heating belt 101.

In the fixing apparatus 6 in this embodiment, the pressing roller 102 is rotated, in accordance with a print command, by a motor (not shown) in a direction indicated by an arrow A at a predetermined peripheral speed (process speed). Rotation of the pressing roller 102 is transmitted at the fixing nip N to the heating belt surface by a frictional force between the surfaces of the pressing roller 102 and the heating belt 101. As a result, the heating belt 101 follows the rotation of the pressing roller 102 to be rotated in a direction indicated by an arrow B while contacting the surface of the slidable member 103 in the fixing nip N side at its inner peripheral surface.

Further, an electrical energy supply control circuit (not shown) is turned on in accordance with the print command, so that an AC voltage (electrical power) is supplied from a power source (not shown) and thus electrical energy is supplied to the halogen heater 104. The halogen heater 104 is turned on by the electrical energy supply to radiate the heat rays. Then, by the heat rays, the inner peripheral surface of the heating belt 101 and a back surface of the slidable member 103 at the side opposite from the fixing nip N side are heated. As a result, the heating belt 101 and the slidable member 103 are quickly increased in temperature.

The electrical energy supply control circuit obtains temperature information of the inner surface of the heating belt 101 detected by a temperature detecting element (not shown), such as a thermistor. Then, on the basis of the detected temperature, the control circuit controls the electrical power supplied to the halogen heater 104 so that the temperature of the halogen heater 104 is kept at a predetermined fixing temperature (target temperature). Here, the fixing temperature refers to a temperature necessary to heat and melt the unfixed toner image formed on the recording material P.

In a state in which the motor is rotated and the heating belt 101 is kept at the fixing temperature, the recording material P on which the unfixed toner image is carried is introduced into the fixing nip N with an image carrying surface toward the heating belt 101. The recording material P is nipped at the fixing nip N by the surfaces of the heating belt 101 and the pressing roller 102 and is conveyed in a nipped state. In this conveying process, the unfixed toner image on the recording material P is heat-fixed on the recording material P by heat of the heating belt 101 and nip pressure at the fixing nip N, and then the recording material P is separated from the surface of the heating belt 101 and is thereafter discharged from the fixing nip N.

(3) Disposition Position of Overheating Preventing Element 107

In FIGS. 1A to 1D, an overheating preventing element 107 is shown. In this embodiment, as the overheating preventing element 107, a thermo switch is used. A connecting member 108 for connecting an electrical wire (electric power cable) connects an electrical wire Ca1 extended from the halogen heater 104 and an electrical wire Ca2 connected to the overheating preventing element 107. An electrical wire Ca3 connects the overheating preventing element 107 and the power source. In this embodiment, as the connecting member 108, a relay connector or a fast on terminal is used. The overheating preventing element 107 is described in this embodiment by taking the thermo switch as an example, but an element, such as a thermal fuse or a thermostat, having a function of interrupting the electrical energy supply to the halogen heater 104 during overheating to protect the fixing apparatus 6 is applicable. Incidentally, each of the thermal fuse, the thermo switch and the thermostat includes a circuit which opens when it is abnormally increased in temperature.

In FIG. 1C, arrows indicated by dotted lines represent radiation directions of the heat rays radiating from the halogen heater 104. Hatched portions represent regions which do not directly receive the heat rays radiating from the halogen heater 104. The overheating preventing element 107 is fixed in the hatched region by the element fixing member 113, and a heat sensitive portion 114 of the overheating preventing element 107 is contacted to the stay 106. That is, the overheating preventing element 107 is provided inside the heating belt 101 at a position where it does not receive directly radiant light emitted from the halogen heater 104.

Here, the element fixing member 113 is a member for fixing the overheating preventing element 107 and for fixing and guiding the electrical wire Ca2 connected to the overheating preventing element 107 while protecting the electrical wire Ca2 from the heat rays. The element fixing member 113 is prepared by a material, having low thermal conductivity, such as a heat resistant resin material.

As described above, the overheating preventing element 107 and the element fixing member 113 are disposed at the position of the stay 106 where they do not receive directly the heat rays radiating from the halogen heater 104, so that it becomes possible to use the overheating preventing element 107 in a temperature range of an operable ambient temperature.

In this embodiment, a constitution is employed in which the overheating preventing element 107 is disposed in the region where the heat rays radiating from the halogen heater 104 are shielded by the stay 106, but the arrangement of the overheating preventing element 107 is not limited to such arrangement that the overheating preventing element 107 is disposed in the region where the heat rays are shielded by the stay 106. For example, the overheating preventing element 107 may also be surrounded by a reflection plate of metal, a resin member having an insulation effect, such as a heat resistant resin material having low thermal conductivity, or an insulation member, and may only be required that the member can shield direct radiation of the heat rays onto the overheating preventing element 107.

In FIG. 1D, arrows indicated by dotted lines represent radiation directions of the heat rays radiating from the halogen heater 104. With respect to the radiation directions of the heat rays, there is no heat-ray shielding member between the halogen heater 104 and the stay 106. For that reason, the leg portion 106*a* of the stay 106 is directly subjected to the radiation of the heat rays from the halogen heater 104.

Further, a spatial distance between the halogen heater 104 and the stay 106 is irrespective of rotation of the heating belt 101 and is not changed. Therefore, the temperature of the stay 106 has a stable linear temperature characteristic that the temperature is increased depending on a turning on time of the halogen heater 104 (heating time by the heat ray rays) and is lowered depending on a turning off time. By employing a constitution in which the temperature of the stay 106 having such a stable linear temperature characteristic is detected by the overheating preventing element 107, improvement in thermal responsiveness of the overheating preventing element 107 can be realized.

In this embodiment, an object for which the overheating preventing element 107 detects its temperature, the stay 106 is used but is not limited to the stay 106. For example, the object may also be a metal member different from the stay 106 or a heat resistant resin member and may only be required to be a member having the stable linear temperature characteristic by the heat rays radiating from the halogen heater 104.

The fixing apparatus 6 in this embodiment performs the following operation at an abnormal time when the turning on of the halogen heater 104 is unintentionally continued. The stay 106 is heated by the heat rays from the halogen heater 104, so that the temperature of the stay 106 is increased. Then, with the increase in temperature of the stay 106 at the longitudinal end portion, the temperature of the heat sensitive portion 114 is increased. When the temperature of the heat sensitive portion 114 reaches the operation temperature of the overheating preventing element 107, the overheating preventing element 107 is operated (i.e., the internal circuit is opened), so that interruption of the electrical energy supply to the halogen heater 104 is performed.

According to the fixing apparatus 6 in this embodiment, the following effects are achieved by the constitution and operation as described above. First, irrespective of the rotation state of the heating belt 101, it is possible to perform a stable operation of the overheating preventing element 107.

Further, the overheating preventing element 107 is disposed in contact with the stay 106 provided inside a cylinder of the heating belt 101. For this reason, compared with the case where the overheating preventing element 107 is disposed in non-contact with the cylinder of the heating belt 101 in the neighborhood of an outside of the cylinder, a time until the overheating preventing element 107 is operated can be shortened. This is because when the overheating preventing element 107 is disposed in contact with the stay 106 provided inside the cylinder of the heating belt 101, the distance between the halogen heater 104 and the stay 106 is short and the stay 106 is formed of metal, and therefore has a higher thermal conductivity than that of an air layer.

Further, the overheating preventing element 107 is prevented by the stay 106 from being directly subjected to radiation of the heat rays from the halogen heater 104, and therefore the temperature of the overheating preventing element 107 itself does not exceed an operable range, so that it is possible to ensure operation reliability of the overheating preventing element 107.

Second Embodiment

In the First Embodiment, the fixing apparatus 6 was described, in which the overheating preventing element 107 is disposed inside the heating belt 101 at the position where the overheating preventing element 107 is not directly subjected to radiation of the heat rays from the halogen heater 104. In this embodiment, a fixing apparatus 6 constituted so that the overheating preventing element 107 is provided at the inner surface of the leg portion 106*a* of the stay 106 will be described. In the following description, members identical to those constituting the fixing apparatus 6 in the First Embodiment are represented by the same reference numerals or symbols and will be omitted from description.

Figure 2:
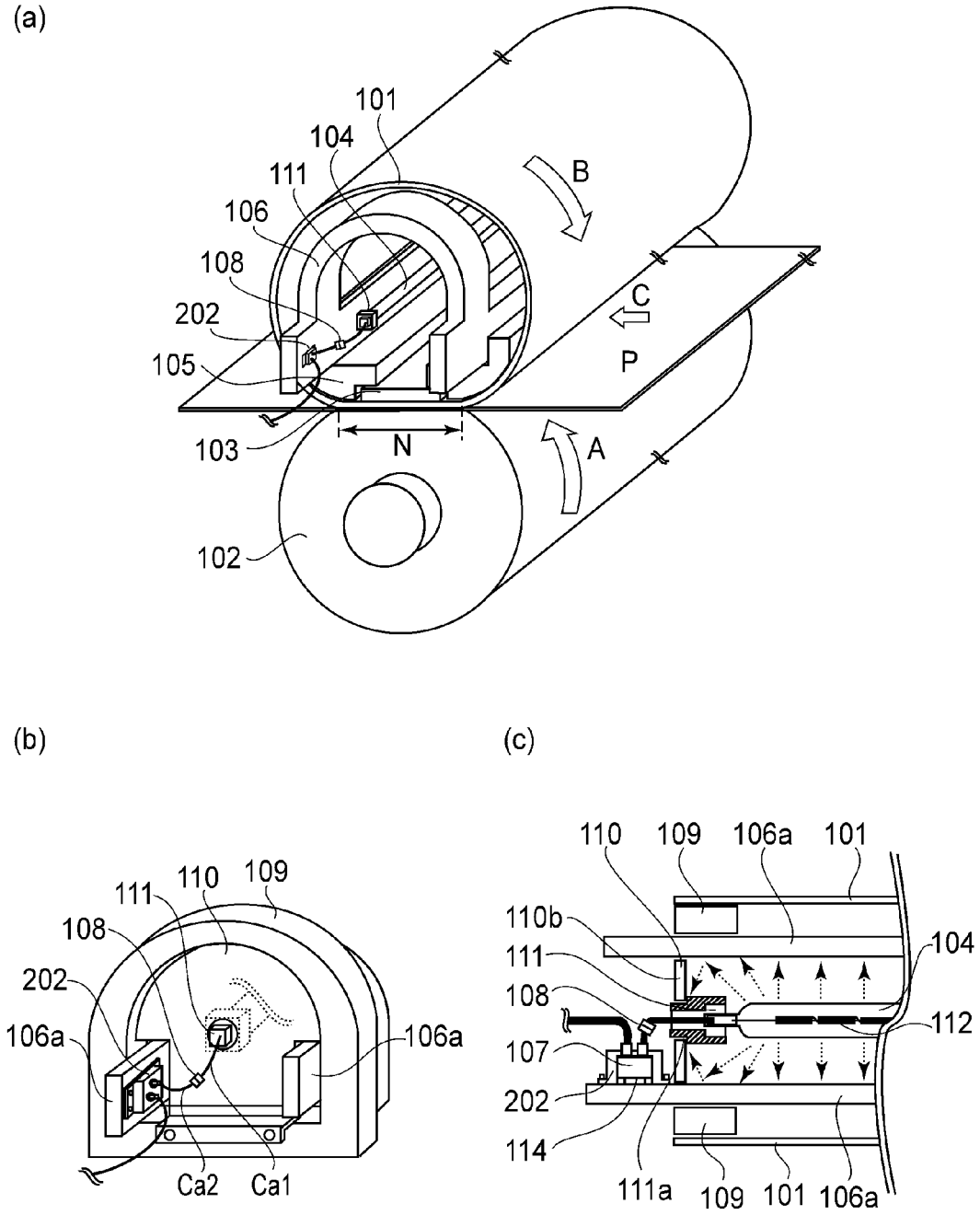
FIG. 2(*a*) is a perspective view of an outer appearance showing a schematic structure of a whole fixing apparatus according to a Second Embodiment.

FIG. 2(*a*) is a perspective view of an outer appearance showing a schematic structure of a whole fixing apparatus 6. FIG. 2(*b*) is a perspective view of an outer appearance of a flange member 109, a heater fixing member 110, a sealing portion 111, and an element fixing member 202, which are provided at a longitudinal end portion of a heating unit. FIG. 2(*c*) is an illustration showing radiation of heat rays from a halogen heater 104 with respect to a longitudinal direction of a heating belt 101 and showing a position of an overheating preventing element 107.

In the following, a disposition position of the overheating preventing element 107 will be described. As described in the First Embodiment, the heater fixing member 110 is provided with the through hole 110*a* so that the leg portion 106*a* of the stay 106 is protruded from the sealing portion 111 of the halogen heater 104 to the outside thereof with respect to the longitudinal direction of FIG. 2(*b*). In this embodiment, an area of the through hole 110*a* is minimized so that the heat rays radiating from the halogen heater 104 are prevented from leaking out of the heater fixing member 110.

As shown in FIGS. 2(*b*) and 2(*c*), the overheating preventing element 107 is fixed by the element fixing member 202 at the inner surface of either one of the two leg portions 106*a* of the stay 106 protruding to the outside of the cylinder of the heating belt 101. Further, the heat sensitive portion 114 of the overheating preventing element 107 contacts the inner surface of the leg portion 106*a*.

Here, the element fixing member 202 protects the overheating preventing element 107 from slight heat rays leaking from the through hole 110*a* of the heater fixing member 110. Further, the element fixing member 202 has a constitution in which the whole overheating preventing element 107 is covered in order to reduce the influence of the overheating preventing element 107 by a flow of ambient air and a change in the ambient environment such as temperature and humidity.

In FIG. 2(*c*), arrows indicated by dotted lines represent radiation directions of the heat rays radiating from the halogen heater 104. With respect to the radiation directions of the heat rays, there is no heat ray shielding member between the halogen heater 104 and the stay 106. For that reason, the stay 106 is directly subjected to the radiation of the heat rays from the halogen heater 104 between itself and the heater fixing member 110.

Further, the spatial distance between the halogen heater 104 and the stay 106 is irrespective of the rotation state of the heating belt 101 and is not changed. Therefore, the temperature of the stay 106 has a stable temperature characteristic that the temperature is increased depending on a turning-on time of the halogen heater 104 (heating time by the heat rays) and is lowered depending on a turning-off time. Therefore, also in the fixing apparatus 6 in this embodiment, similarly as in the fixing apparatus 6 in the First Embodiment, improvement in the thermal responsiveness of the overheating preventing element 107 can be realized.

Further, also the electrical wires Ca1 and Ca2 are protected by the heater fixing member 110 from being directly subjected to the radiation of the heat rays from the halogen heater 104.

Further, the overheating preventing element 107 may desirably be fixed at a place close to the heater fixing member 110 so that the overheating preventing element 107 can monitor a temperature change depending on the turning-on time and the turning-off time of the halogen heater 104 with high sensitivity.

The fixing apparatus 6 in this embodiment performs the following operation at an abnormal time when the turning on of the halogen heater 104 is unintentionally continued. The stay 106 is heated by the heat rays from the halogen heater 104, so that the temperature of the stay 106 is increased. The temperature of the stay 106 subjected directly to the radiation of the heat rays from the halogen heater 104 is transmitted to the end portion of the stay 106 where the stay 106 is not subjected directly to the radiation of the heat rays from the halogen heater 104, so that the temperature of the stay 106 at the end portion of the stay 106 is increased. Then, with the increase in temperature of the stay 106 at the longitudinal end portion, the temperature of the heat sensitive portion 114 is increased. When the temperature of the heat sensitive portion 114 reaches an operation temperature of the overheating preventing element 107, the overheating preventing element 107 is operated, so that interruption of the electrical energy supply to the halogen heater 104 is made.

As described above, by providing the metal member which is provided inside the belt and includes a protruded portion protruding from the cylinder of the belt and which is directly subjected to radiation of radiant light emitted from the heater, the overheating preventing element may have a constitution in which the temperature of the metal member is detected at the protruded portion of the metal member.

According to the fixing apparatus 6 in this embodiment, in addition to the effects in the First Embodiment, the following effects can be obtained. By the heater fixing member 110 and the element fixing member 202, the overheating preventing element 107 is not subjected directly to the radiation of the heat rays from the halogen heater 104, and therefore it is possible to ensure the operation reliability of the overheating preventing element 107. Further, the leg portion 106*a* of the stay 106 is extended in the longitudinal direction, and at the inner surface of the extended leg portion 106*a*, the overheating preventing element 107 is disposed. For that reason, the electrical wires Ca1, Ca2 and Ca3 for supplying the electrical energy to the halogen heater 104 can be made shorter than those of the fixing apparatus 6 in the First Embodiment, and an electrical wire holding member provided inside the cylinder of the heating belt 101 can be made unnecessary, so that it is possible to realize an overheating preventing function with an inexpensive constitution.

Third Embodiment

In the First and Second Embodiments, the fixing apparatus 6, in which the overheating preventing element 107 is disposed on the stay 106, was described. In this embodiment, a fixing apparatus 6 constituted so that the overheating preventing element 107 is provided on a metal member different from the stay 106 will be described. In the following description, members identical to those constituting the fixing apparatus 6 in the First Embodiment are represented by the same reference numerals or symbols and will be omitted from description.

Also in this embodiment, by providing the metal member, which is provided inside the belt and includes a protruded portion protruding from the cylinder of the belt and which is directly subjected to radiation of radiant light emitted from the heater, the overheating preventing element has a constitution in which the temperature of the metal member is detected at the protruded portion of the metal member.

Figure 3:
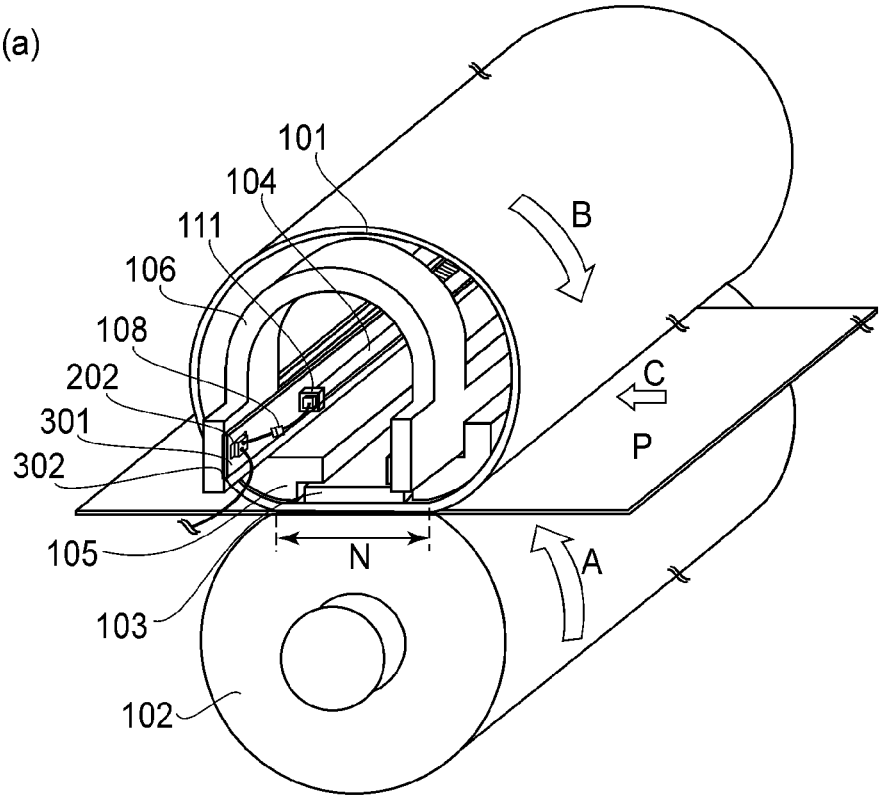
FIG. 3(*a*) is a perspective view of an outer appearance showing a schematic structure of a whole fixing apparatus according to a Third Embodiment.
Figure 3:
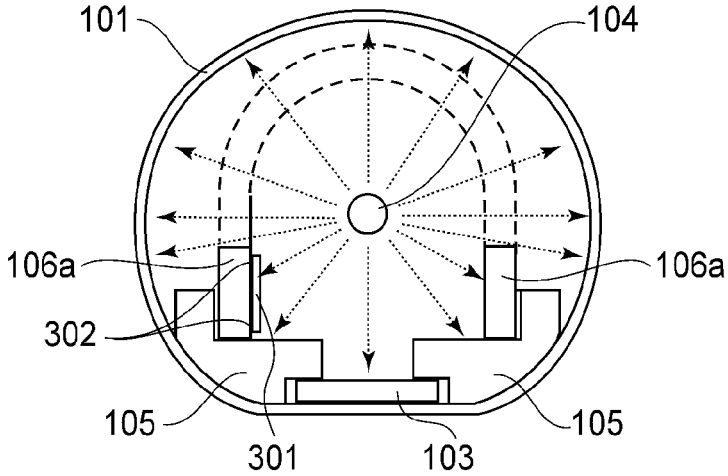

FIGS. 3(*a*) and 3(*b*) are illustrations showing a constitution of the fixing apparatus 6 of the belt type and the arrangement of the overheating preventing element 107. FIG. 3(*a*) is a perspective view of an outer appearance showing a schematic structure of the whole fixing apparatus 6 according to a Third Embodiment. FIG. 3(*b*) is an illustration showing radiation of heat rays from the halogen heater 104 with respect to a radial direction of the heating belt 101 and showing a position of the overheating preventing element 107.

In FIG. 3(*a*), in order to illustrate an inside structure of the heating belt 101, the heater fixing member 110 is omitted from illustration.

In the fixing apparatus 6 in the First and Second Embodiments, the stay 106 is the metal and in order to provide rigidity capable of withstanding the pressure for effecting pressure supporting, the thickness of the stay 106 is required to be several mm which is relatively large, so that the thermal capacity is large. For that reason, there is a possibility of the generation of delay in the time from the start of the turning on of the halogen heater 104 until the temperature of the stay 106 starts its rise. Therefore, the overheating preventing element was provided on the metal member 301 different from the stay 106.

As shown in FIG. 3(*b*), the metal member 301 is disposed at the inner surface of the leg portion 106*a* of the stay 106 via a spacer member 302 along the longitudinal direction of the stay 106.

Here, the spacer member 302 effects insulation separation between the metal member 301 and the stay 106, thus improving the thermal responsiveness of the metal member 301. The spacer member 302 may be any member if the member has an insulation effect and, e.g., uses heat resistant resin or metal having low thermal conductivity. Further, as the metal member 301, in order to improve the thermal responsiveness, a member having a sufficiently small thermal capacity compared with that of the stay 106 is selected. Further, the metal member 301 may also be made black at its surface in order to improve the thermal responsiveness, thus enhancing a heat collection property.

In this embodiment, the metal member 301 is provided along the entire longitudinal direction of the stay 106, but if there is sufficiently no problem with respect to the thermal responsiveness of the metal member 301, in order to reduce the cost, the longitudinal length of the metal member 301 may also be shortened. In this case, a constitution in which the metal member 301 is disposed only at a position where the metal member 301 opposes the halogen heater 104 at a longitudinal end portion of the halogen heater 104 is employed.

As shown in of FIG. 3(*b*), the metal member 301 is disposed via the spacer member 302 at the inner surface of the leg portion 106*a* of the stay 106 between the halogen heater 104 and the stay 106. In FIG. 3(*b*), arrows indicated by dotted lines represent radiation directions of the heat rays radiating from the halogen heater 104. With respect to the radiation directions of the heat rays, there is no radiation shielding member between the halogen heater 104 and the metal member 301, so that the metal member 301 is directly subjected to the radiation of the heat rays from the halogen heater 104 at its entire inner surface.

Further, the spatial distance between the halogen heater 104 and the metal member 301 is irrespective of the rotation state of the heating belt 101 and is not changed. Therefore, the temperature of the metal member 301 has a stable temperature characteristic that the temperature is increased depending on a turning-on time of the halogen heater 104 (heating time by the heat rays) and is lowered depending on a turning-off time. Thus, by using the metal member 301 having the stable temperature characteristic, improvement in thermal responsiveness of the overheating preventing element 107 can be realized.

The fixing apparatus 6 in this embodiment performs the following operation at an abnormal time when the turning on of the halogen heater 104 is unintentionally continued. The metal member 301 is heated by the heat rays from the halogen heater 104, so that the temperature of the metal member 301 is increased. Then, with the increase in temperature of the metal member 301 at the longitudinal end portion, the temperature of the heat sensitive portion 114 is increased. When the temperature of the heat sensitive portion 114 reaches an operation temperature of the overheating preventing element 107, the overheating preventing element 107 is operated, so that interruption of the electrical energy supply to the halogen heater 104 is made.

According to the fixing apparatus 6 in this embodiment, by the above-described constitution and operation, in addition to the effects of the fixing apparatus 6 in the Second Embodiment, the following effects can be obtained. The overheating preventing element 107 is disposed on the metal member 301, having the small thermal capacity, different from the stay 106 having the small thermal capacity, and therefore the operation time of the overheating preventing element 107 can be further shortened.

In this embodiment, an example in which the overheating preventing element 107 is provided via the metal member 301 at the inner surface of the leg portion 106*a* of the stay 106 of the fixing apparatus 6 in the Second Embodiment was described, but the constitution of the fixing apparatus 6 in this embodiment is also applicable to the constitution of the fixing apparatus 6 in the First Embodiment. In this case, the element fixing member 113 provided with the overheating preventing element 107 is mounted via the metal member 301 on the outer surface of the leg portion 106*a* of the stay 106 of the fixing apparatus 6 in the First Embodiment.

Fourth Embodiment

In the Second Embodiment, the fixing apparatus 6 in which the heat sensitive portion 114 of the overheating preventing element 107 directly contacts to the inner surface of the leg portion 106*a* of the stay 106 was described. In this embodiment, a fixing apparatus 6 constituted so that the heat sensitive portion 114 is provided in non-contact state via a spacer member 401 for maintaining the distance between the stay 106 and the heat sensitive portion 114 will be described. In the following description, members identical to those constituting the fixing apparatus 6 in the Second Embodiment are represented by the same reference numerals or symbols and will be omitted from description.

Figure 4:
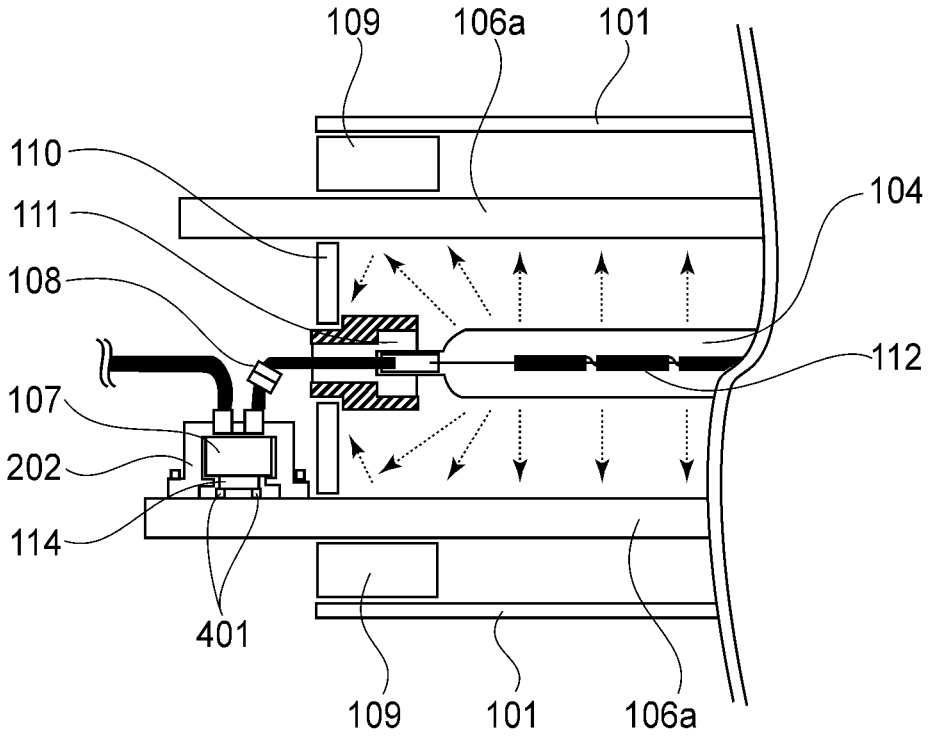
FIG. 4 is an illustration showing a constitution in which an overheating preventing element in a fixing apparatus according to a Fourth Embodiment is provided.

FIG. 4 is an illustration showing a constitution in which the overheating preventing element 107 in the fixing apparatus 6 in this embodiment is disposed.

As shown in FIG. 4, the overheating preventing element 107 is disposed via a spacer member 401 for ensuring the distance between the leg portion 106*a* of the stay 106 and the heat sensitive portion 114, and is pressed against the inner surface of the leg portion 106*a* by the element fixing member 202. The distance between the inner surface of the leg portion 106*a* and the heat sensitive portion 114 is ensured by the spacer member 401 and is not influenced by the state of the heating belt 101, and therefore the operation time of the overheating preventing element 107 is stable.

Here, as the spacer member 401, a resin member which is softened at a predetermined temperature is used. The material and thickness of the spacer member 401 can be appropriately selected in accordance with setting of the operation temperature of the overheating preventing element 107. Therefore, the heat sensitive portion 114 is lower in temperature than the stay 106 by the spacer member 401.

The fixing apparatus 6 in this embodiment performs the following operation at an abnormal time when the turning on of the halogen heater 104 is unintentionally continued. The stay 106 is heated by the heat rays from the halogen heater 104, so that the temperature of the stay 106 is increased. Then, with the increase in temperature of the stay 106 at the longitudinal end portion, the temperatures of the spacer member 401 and the heat sensitive portion 114 are increased. The spacer member 401 is softened when its temperature reaches a predetermined temperature, so that the heat sensitive portion 114 approaches the stay 106. When the temperature of the heat sensitive portion 114 reaches an operation temperature of the overheating preventing element 107, the overheating preventing element 107 is operated, so that interruption of the electrical energy supply to the halogen heater 104 is made.

According to the fixing apparatus 6 in this embodiment, by the above-described constitution and operation, in addition to the effects of the fixing apparatus 6 in the Second Embodiment, the following effects can be obtained. The heat sensitive portion 114 of the overheating preventing element 107 is disposed over the stay 106 via the spacer member 401, and therefore compared with the case where the overheating preventing element 107 is directly disposed on the stay 106, the temperature of the heat sensitive portion 114 becomes low. Therefore, it is possible to select an inexpensive overheating preventing element 107 having a low operation temperature.

In this embodiment, a description was provided by using the constitution of the fixing apparatus 6 in the Second Embodiment, but the constitution of the fixing apparatus 6 in this embodiment is also applicable to the constitutions of the fixing apparatuses 6 in the First and Third Embodiments. In the case where the constitution of the fixing apparatus 6 in this embodiment is applied to the fixing apparatus 6 in the First Embodiment, the heat sensitive portion 114 is disposed in a non-contact state via the spacer member 401 for ensuring the distance between the leg portion 106*a* of the stay 106 and the heat sensitive portion 114. In the case where the constitution of the fixing apparatus 6 in this embodiment is applied to the fixing apparatus 6 in the Third Embodiment, the heat sensitive portion 114 is disposed in a non-contact state via the spacer member 401 for ensuring the distance between the metal member 301 and the heat sensitive portion 114.

Other Embodiments

The use of the fixing apparatuses 6 in the First to Fourth Embodiments is not limited to the use as the apparatus for heat fixing, on the recording material P, the unfixed toner image carried on the recording material P. For example, the fixing apparatuses 6 can be used also as an image heating apparatus for heating the unfixed toner image to temporarily fix the unfixed toner image on the recording material or as an image heating apparatus for heating the toner image heat fixed on the recording material to impart glossiness to the toner image surface.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 108474/2012 filed May 10, 2012, which is hereby incorporated by reference.

What is claimed is:

1. An image heating apparatus comprising:

a rotatable cylindrical belt;

a heater, provided inside said belt, configured to heat said belt; and an overheating preventing element, including a circuit which is opened when an abnormal temperature rise occurs, configured to interrupt electrical power supply to said heater, wherein said overheating preventing element is provided at a position, inside said belt, where said overheating preventing element is free from direct heat radiation emitted from said heater.

2. An image heating apparatus according to claim 1, further comprising a metal member provided at a position, inside said belt, where said metal member is subjected to the direct heat radiation emitted from said heater, wherein said overheating preventing element detects a temperature of said metal member.

3. An image heating apparatus according to claim 2, wherein said overheating preventing element is blocked by said metal member from the direct heat radiation emitted from said heater.

4. An image heating apparatus according to claim 2, wherein said metal member is a stay configured to impart rigidity to said image heating apparatus.

5. An image heating apparatus according to claim 4, wherein said overheating preventing element is blocked by said stay from the direct heat radiation emitted from said heater.

6. An image heating apparatus according to claim 5, wherein said stay is provided to surround said heater, and said overheating preventing element is provided on a side of a stay surface opposite from another stay surface opposing said heater.

7. An image heating apparatus according to claim 2, wherein said overheating preventing element is mounted to said metal member via a spacer.

8. An image heating apparatus according to claim 1, wherein said overheating preventing element is a thermo switch or a thermal fuse.

9. An image heating apparatus comprising:

a rotatable cylindrical belt;

a heater, provided inside said belt, configured to heat said belt;

an overheating preventing element, including a circuit which is opened when an abnormal temperature rise occurs, configured to interrupt electrical power supply to said heater; and a metal member provided at a position, inside said belt, where said metal member is subjected to direct heat radiation emitted from said heater, wherein said metal member includes a protruded portion protruded from an end of said belt with respect to a direction of a generatrix of said belt, wherein said overheating preventing element detects a temperature of said metal member at the protruded portion of said metal member.

10. An image heating apparatus according to claim 9, further comprising a shielding member, provided at an end portion of said belt with respect to the generatrix direction, configured to shield the heat radiation emitted from said heater, wherein said overheating preventing element is shielded by said shielding member from the heat radiation emitted from said heater.

11. An image heating apparatus according to claim 9, wherein said metal member is a stay configured to impart rigidity to said image heating apparatus.

12. An image heating apparatus according to claim 9, wherein said overheating preventing member is mounted to said metal member via a spacer.

13. An image heating apparatus according to claim 9, wherein said overheating preventing element is a thermo switch or a thermal fuse.

* * * * *